US010604375B2

(12) United States Patent
Oba

(10) Patent No.: US 10,604,375 B2
(45) Date of Patent: Mar. 31, 2020

(54) WINDING METHOD AND WINDING DEVICE

(71) Applicant: FUJIFILM Corporation, Tokyo (JP)

(72) Inventor: Takahiro Oba, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 301 days.

(21) Appl. No.: 15/718,627

(22) Filed: Sep. 28, 2017

(65) Prior Publication Data

US 2018/0093850 A1 Apr. 5, 2018

(30) Foreign Application Priority Data

Sep. 30, 2016 (JP) ..... 2016-194114

(51) Int. Cl.

| | |
|---|---|
| ***B65H 75/10*** | (2006.01) |
| ***B65H 75/02*** | (2006.01) |
| ***B65H 23/18*** | (2006.01) |
| ***B65H 18/26*** | (2006.01) |
| ***B65H 23/195*** | (2006.01) |

(52) U.S. Cl.

CPC ..... *B65H 75/025* (2013.01); *B65H 18/26* (2013.01); *B65H 23/18* (2013.01); *B65H 23/1955* (2013.01); *B65H 75/10* (2013.01); *B65H 2301/4127* (2013.01); *B65H 2301/414324* (2013.01); *B65H 2701/1752* (2013.01); *B65H 2701/1918* (2013.01); *B65H 2801/61* (2013.01)

(58) Field of Classification Search

CPC ..... B65H 75/025; B65H 75/10; B65H 23/18; B65H 23/1955; B65H 18/26

See application file for complete search history.

(56) References Cited

U.S. PATENT DOCUMENTS 6,416,013 B1 * 7/2002 Benzing, II ..... B29D 30/0016 242/536

FOREIGN PATENT DOCUMENTS

| | | | |
|---|---|---|---|
| JP | 63-175061 | U | 11/1988 |
| JP | 03-085277 | A | 4/1991 |
| JP | 20004-259881 | A | 9/2004 |
| JP | 2006-294536 | A | 10/2006 |
| JP | 5622089 | B2 | 11/2014 |
| WO | 2012/169368 | A1 | 12/2012 |

OTHER PUBLICATIONS

Office Action, issued by the Japanese Patent Office dated May 21, 2019, in connection with Japanese Patent Application No. 2016-194114.

* cited by examiner

*Primary Examiner* — Sang K Kim

(74) *Attorney, Agent, or Firm* — Edwards Neils LLC; Jean C. Edwards, Esq.

(57) ABSTRACT

A guide film supply mechanism feeds a guide film toward a winding mechanism. The guide film is a film in which a pair of supports, which is long in the longitudinal direction of a base film and is thicker than a product film, is disposed on both side portions of the upper surface of the base film that is formed to have a width larger than the width of the product film. A product film supply mechanism feeds the product film toward the upper surface of the guide film. The winding mechanism forms a film roll by winding the product film for each guide film. The tension of the product film is set to be smaller than the tension of the guide film.

11 Claims, 5 Drawing Sheets

WINDING METHOD AND WINDING DEVICE

CROSS-REFERENCE TO RELATED APPLICATION

This application claims priority under 35 USC 119 from Japanese Patent Application No. 2016-194114, filed 30 Sep. 2016, the disclosure of which is incorporated by reference herein.

BACKGROUND OF THE INVENTION

1. Field of the Invention

The present invention relates to a winding method and a winding device that wind a product film in the form of a film roll.

2. Description of the Related Art

In facilities for manufacturing functional films, such as a magnetic tape, a photograph film, an optical film, and a porous film, a manufactured long product film is shipped and stored as a film roll that is wound in the form of a roll by a winding device.

Further, JP2006-294536A discloses a structure that winds a product film for each support in a state in which wound supports having the same size as the product film are bonded to the back of the product film. Furthermore, WO2012/169368A and JP5622089B disclose structures that wind a product film in a state in which supports having a size smaller than the product film are bonded to the back of the product film. Specifically, WO2012/169368A discloses an example in which supports extending in the longitudinal direction of a product film are provided on both side portions of the product film in a width direction. Moreover, JP5622089B discloses an example in which supports extending in the width direction of a product film are arranged at intervals in the longitudinal direction of the product film.

However, since the surface of the product film is in contact with the backs of the supports in a film roll in JP2006-294536A, there are problems that the product film is pressed and crushed in a thickness direction in the film roll in a case in which the product film is pulled with high tension and winding displacement or the like occurs and causes damage to the surface of the product film in a case in which tension is reduced during the winding.

Further, in WO2012/169368A and JP5622089B, the surface of the product film can be protected since a space (an air space) is formed between a portion, on which the supports are not provided, of the back of the product film and the surface of the product film. However, since sufficient tension cannot be applied to the portion, on which the supports are not provided, of the back of the product film, there is a problem that the product film loosens and the back and surface of the product film are in contact therewith (the air space cannot be kept).

SUMMARY OF THE INVENTION

The invention has been made in consideration of the above-mentioned background, and an object of the invention is to provide a winding method and a winding device that can prevent the slack of a product film while forming an air space on the surface of the product film in a film roll.

In order to achieve the object, a winding method of the invention, which winds a product film in the form of a film roll, comprises: a guide film supply step of supplying a guide film, which supports the product film from a back side, toward a winding core; a product film supply step of supplying the product film to a surface side of the guide film; and a winding step of winding the guide film around the winding core in the form of the film roll together with the product film supplied to the surface side of the guide film. A support, which is formed to have a thickness larger than the thickness of the product film, is provided on the surface of the guide film, and a space is formed between the surface and back of the guide film by the support in the form of the film roll. In the winding step, the product film is disposed in the space and is wound in the form of the film roll together with the guide film.

In the guide film supply step, tension of the guide film in a winding direction may be controlled to first tension and the guide film may be supplied to the winding core. In the product film supply step, tension of the product film in the winding direction may be controlled to second tension and the product film may be supplied to the surface of the guide film.

The first tension may be larger than the second tension.

The modulus of elasticity of the guide film may be in the range of 0.1 GPa to 200 GPa.

The thickness of the guide film may be in the range of 10 μm to 1000 μm.

The area of a portion, on which the support is provided, of the surface of the guide film may be in the range of 0.1% to 30% of the area of the entire surface of the guide film.

The back of the product film may be adhered to the surface of the guide film.

The product film may be an optical film.

The product film may be a porous film.

Further, a winding device of the invention, which winds a product film in the form of a film roll, comprises: a guide film supply mechanism that supplies a guide film, which supports the product film from a back side, toward a winding core; a product film supply mechanism that supplies the product film to a surface side of the guide film; and a winding mechanism that winds the guide film around the winding core in the form of the film roll together with the product film supplied to the surface side of the guide film. A support, which is formed to have a thickness larger than the thickness of the product film, is provided on the surface of the guide film, and a space is formed between the surface and back of the guide film by the support in the form of the film roll. In the winding mechanism, the product film is disposed in the space and is wound in the form of the film roll together with the guide film.

Tension of the guide film in a winding direction may be controlled to first tension and the guide film may be supplied to the winding core, and tension of the product film in the winding direction may be controlled to second tension and the product film may be supplied to the surface of the guide film.

In the invention, a product film is wound for each guide film in a state in which the product film overlaps the guide film on which supports thicker than the product film are provided. Accordingly, an air space is formed on the surface of the product film, so that the product film can be protected. Further, the product film also does not loosen in a case in which the guide film does not loosen. That is, since it is possible to prevent the slack of the product film by applying tension to the guide film without applying tension to the product film, it is possible to reliably keep an air space.

DESCRIPTION OF THE PREFERRED EMBODIMENTS

Figure 1:
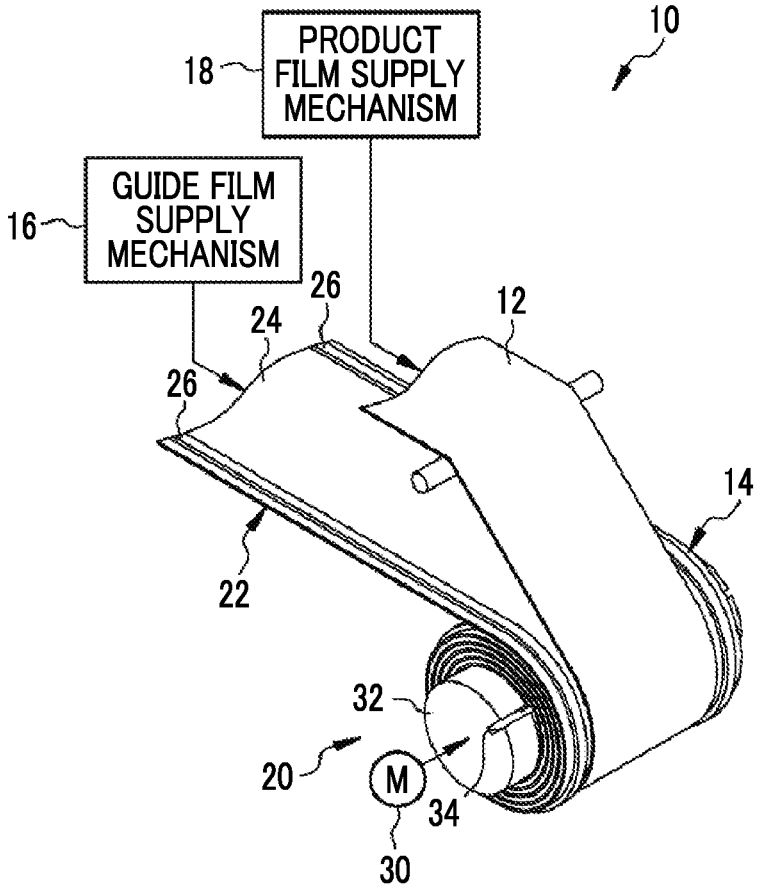
FIG. 1 is a view showing a winding device.

In FIG. 1, a winding device 10 is to form a film roll 14 by winding a product film 12, which is manufactured by a film manufacturing apparatus (not shown), in the form of a roll, and includes a guide film supply mechanism 16, a product film supply mechanism 18, and a winding mechanism 20.

The guide film supply mechanism 16 feeds (supplies) a guide film 22 to the winding mechanism 20. The guide film supply mechanism 16 includes, for example, film supply means, such as a feed roller supporting the guide film 22 from the lower surface (back) side, and supplies the guide film 22 by controlling the drive of the film supply means.

Further, the guide film supply mechanism 16 controls a supply force at the time of supply of the guide film 22 by controlling the drive of the film supply means. Furthermore, the guide film supply mechanism 16 controls tension Tg (first tension) of the guide film in cooperation with the winding mechanism 20 to be described below. Specifically, the guide film 22 is pulled in a longitudinal direction by the winding mechanism 20 to be described below, and a difference between a pulling force for pulling the guide film 22 and a supply force, which is generated in a case in which the guide film supply mechanism 16 supplies the guide film 22, is the tension Tg of the guide film 22. The guide film supply mechanism 16 controls the supply force for supplying the guide film 22 and the winding mechanism 20 controls the pulling force for pulling the guide film 22, so that the guide film supply mechanism 16 and the winding mechanism 20 control the tension Tg of the guide film 22.

The control of the supply force for supplying the guide film 22, which is performed by the guide film supply mechanism 16, includes not only controlling the supply force by changing the supply force but also maintaining the supply force constant. In a case in which the supply force for supplying the guide film 22 is constant, the tension Tg of the guide film 22 is determined (controlled) by the pulling force for pulling the guide film 22 that is generated by the winding mechanism 20.

Likewise, the control of the pulling force for pulling the guide film 22, which is performed by the winding mechanism 20, includes not only controlling the pulling force by changing the pulling force but also maintaining the pulling force constant. In a case in which the pulling force for pulling the guide film 22 is constant, the tension Tg of the guide film 22 is determined (controlled) by the supply force for supplying the guide film 22 that is generated by the guide film supply mechanism 16.

It is preferable that the tension Tg of the guide film 22 is set as high as possible in a range in which distortion and fracture are not generated on the guide film 22. As the tension Tg of the guide film 22 is higher, it is more difficult for slack or winding displacement to occur in a case in which the guide film is wound in the form of the film roll 14. In order to increase the tension Tg of the guide film 22 in this way, the winding device may be adapted so that, for example, the guide film supply mechanism 16 applies the brakes to the supply of the guide film 22, that is, a supply force, which is generated in a case in which the guide film supply mechanism 16 supplies the guide film 22, is negative and the winding mechanism 20 pulls the guide film 22 against this braking (the negative supply force).

Figure 2:
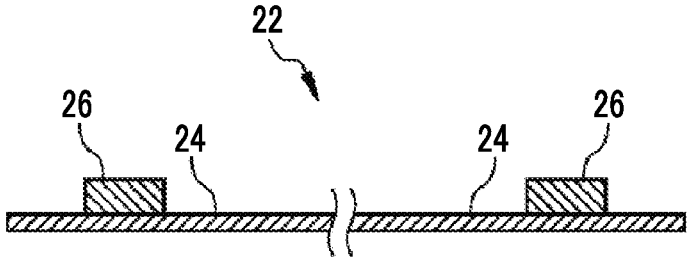
FIG. 2 is a cross-sectional view of a guide film.

As shown in FIG. 2, the guide film 22 is a film in which a pair of supports 26 is disposed on the upper surface (surface) of a base film 24. The base film 24 is formed to have a width larger than the width of the product film 12. Further, the base film 24 is made of a material that has a modulus of elasticity higher than the modulus of elasticity of the product film 12, that is, is not easily deformed (is not easily stretched) even though tension is applied (for example, aluminum, iron, or the like).

The supports 26 are made of, for example, plastic and are formed to be long in the longitudinal direction of the base film 24 (the guide film 22). Further, in this embodiment, the supports 26 are disposed on the upper surface (surface) of the base film 24 at both side portions in the width direction so as to face each other with the product film 12 interposed therebetween in the width direction of the product film 12 in a case in which the guide film 22 is wound together with the product film 12 (see FIG. 3). Further, the supports 26 are formed to have a thickness larger than the thickness of the product film 12.

It is preferable that the modulus of elasticity of the base film 24 of the guide film 22 is in the range of 0.1 GPa to 200 GPa.

Since the guide film 22 is likely to be deformed in a case in which the modulus of elasticity of the base film 24 is reduced, a concern that the guide film 22 may loosen is increased in a case in which the guide film 22 is wound in the form of a roll. Since it is difficult for the guide film 22 to be deformed in a case in which the modulus of elasticity of the base film 24 is increased, it is difficult to wind the guide film 22 in the form of a roll. However, in a case in which the modulus of elasticity of the base film 24 is set in the above-mentioned range, slack can be prevented and the guide film 22 can be smoothly wound.

Further, it is preferable that the thickness of the base film 24 of the guide film 22 is in the range of 10 μm to 1000 μm.

Since the guide film 22 is likely to be deformed in a case in which the thickness of the base film 24 is reduced, a concern that the guide film 22 may loosen is increased in a case in which the guide film 22 is wound in the form of a roll. Since it is difficult for the guide film 22 to be deformed in a case in which the thickness of the base film 24 is increased, it is difficult to wind the guide film 22 in the form of a roll. However, in a case in which the thickness of the base film 24 is set in the above-mentioned range, slack can be prevented and the guide film 22 can be smoothly wound.

Furthermore, it is preferable that the area of a portion, on which the supports 26 are provided, of the surface of the base film 24 of the guide film 22 is in the range of 0.1% to 30% of the area of the entire surface of the base film 24.

Since the supports 26 are crushed at the time of winding the guide film 22 in the form of a roll in a case in which the area of a portion, on which the supports 26 are provided, of the surface of the base film 24 is reduced, a concern that gaps 40 (see FIG. 3) to be described below may be closed is increased. The area of a portion on which the product film 12 is to be placed is reduced in a case in which the area of a portion, on which the supports 26 are provided, of the surface of the base film 24 is increased. However, in a case in which the area of a portion, on which the supports 26 are provided, of the surface of the base film 24 is set in the above-mentioned range, the area of a portion on which the product film 12 is to be placed can also be sufficiently ensured while the closing of the gaps 40 is prevented.

The guide film 22 is repeatedly used in this embodiment. Specifically, the guide film 22 and the product film 12 are wound together with each other and are shipped in the form of the film roll 14, and the product film 12 is separated and recovered alone at the destination alone and is used again in the winding device 10.

Returning to FIG. 1, the product film 12, which is manufactured by the film manufacturing apparatus, is transported to the product film supply mechanism 18. The product film supply mechanism 18 sends (supplies) the transported product film 12 toward the upper surface (surface) of the guide film 22. The product film supply mechanism 18 includes, for example, film supply means, such as a feed roller supporting the product film 12 from the lower surface (back) side, and supplies the product film 12 by controlling the drive of the film supply means.

Further, the product film supply mechanism 18 controls a supply force at the time of supply of the product film 12 by controlling the drive of the film supply means. Furthermore, the product film supply mechanism 18 controls tension Ts (second tension) of the product film 12 in cooperation with the winding mechanism 20 to be described below. Specifically, the product film 12 is placed on the upper surface (surface) of the above-mentioned guide film 22 and is pulled in the longitudinal direction with the movement of the guide film 22, and a difference between this pulling force (that is, a pulling force for pulling the guide film 22 by the winding mechanism 20) and a supply force, which is generated in a case in which the product film supply mechanism 18 supplies the product film 12, is the tension Ts of the product film 12. The product film supply mechanism 18 controls the supply force for supplying the product film 12 and the winding mechanism 20 controls the pulling force for pulling the product film 12 (the guide film 22), so that the product film supply mechanism 18 and the winding mechanism 20 control the tension Ts of the product film 12.

The control of the supply force for supplying the product film 12, which is performed by the product film supply mechanism 18, includes not only controlling the supply force by changing the supply force but also maintaining the supply force constant. In a case in which the supply force for supplying the product film 12 is constant, the tension Ts of the product film 12 is determined (controlled) by the pulling force for pulling the product film 12 (the guide film 22) that is generated by the winding mechanism 20.

Likewise, the control of the pulling force for pulling the product film 12 (the guide film 22), which is performed by the winding mechanism 20, includes not only controlling the pulling force by changing the pulling force but also maintaining the pulling force constant. In a case in which the pulling force for pulling the product film 12 (the guide film 22) is constant, the tension Ts of the product film 12 is determined (controlled) by the supply force for supplying the product film 12 that is generated by the product film supply mechanism 18.

It is preferable that the tension Ts of the product film 12 is set as low as possible in a range in which wrinkles are not generated on the product film 12. In this embodiment, the tension Ts of the product film 12 is set to be smaller than the tension Tg of the above-mentioned guide film 22. Accordingly, since stress (extra tension) applied to the product film 12 can be reduced, the distortion, fracture, or the like of the product film 12 can be prevented.

The product film 12 is, for example, an optical film or a porous film. Examples of the optical film include an orientation film in which an oriented film is formed on a base material made of a polymer, such as cellulose acylate. Further, examples of the porous film include a cell culture film, a medical film, and an electrode film having a plurality of fine holes (of which the diameter is in the range of about 1 to 100 μm). However, since the invention is not limited by the type or use of the product film 12, the product film 12 may be an arbitrary film.

The product film 12 may be manufactured at a place separate from the winding device 10 and may be supplied to the winding device 10, but it is preferable that an outlet portion of the film manufacturing apparatus may be connected to an outlet portion of the winding device 10 so that the product film is directly supplied from the film manufacturing apparatus. In this case, the film manufacturing apparatus functions as the product film supply mechanism 18.

Further, in a case in which the film manufacturing apparatus is directly connected to the winding device 10 and functions as the product film supply mechanism 18 as described above, the supply force for supplying the product film 12 is a force for feeding the product film 12 manufactured by the film manufacturing apparatus. That is, in a case in which the film manufacturing apparatus is directly connected to the winding device 10 and functions as the product film supply mechanism 18, for example, the product film 12 is fed to the winding device 10 from the film manufacturing apparatus by a feed roller, such as a suction drum, (a drive roller that pulls a film from the previous process and sends the film to the next process) and a force for feeding the product film 12 by the feed roller is the supply force for supplying the product film 12.

The winding mechanism 20 forms the film roll 14 by winding a product film 12 for each guide film 22. The winding mechanism 20 is provided with a motor 30 and a columnar winding core 32 that is rotated about an axis thereof by the supply of a drive force from the motor 30. A slit-shaped opening 34, which is parallel to the central axis of the winding core 32, is formed on the peripheral surface of the winding core 32, and end portions of the guide film 22 and the product film 12 in the longitudinal direction are inserted into the opening 34 and are held by the opening 34. The winding mechanism 20 rotates the winding core 32 by the supply of a drive force from the motor 30 in this state to wind the product film 12 for each guide film around the winding core 32 and to form the film roll 14. A method of fixing the guide film 22 and the product film 12 to the winding core 32 is not limited to the holding using the above-mentioned opening 34, and well-known various methods can be used as the method. For example, end portions of the guide film 22 and the product film 12 in the longitudinal direction may be attached to the peripheral surface of the winding core 32 by an adhesive tape or the like.

Figure 3:
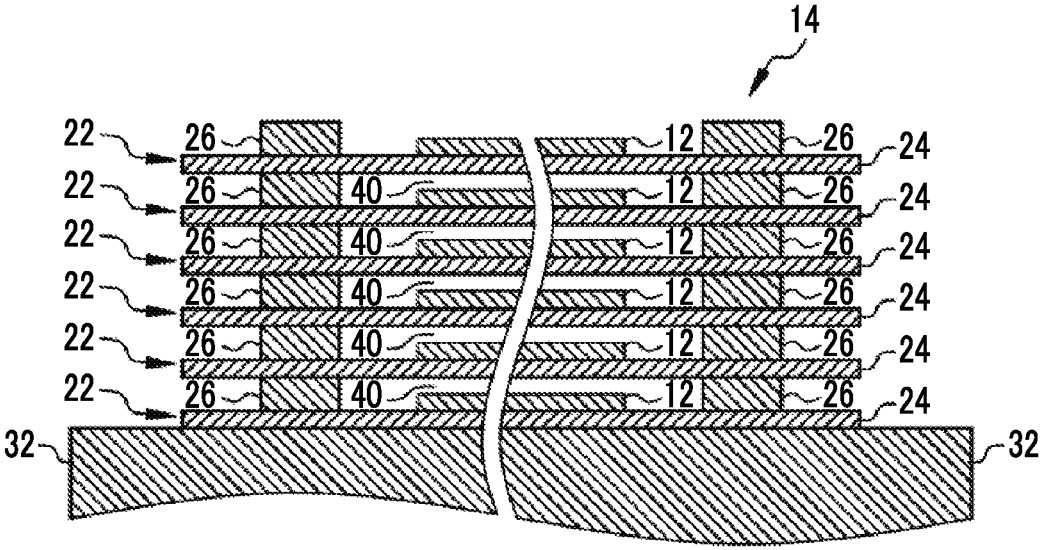
FIG. 3 is a cross-sectional view of a film roll.

As shown in FIG. 3, in the film roll 14, the guide film 22 is wound in a state in which a space is formed between the upper surface (surface) and the lower surface (back) of the base film 24 by the supports 26. Further, the product film 12 is disposed between the supports 26 in a state in which the upper surface (surface) and the lower surface (back) of the guide film 22 face each other. Since the thickness of the support 26 is larger than the thickness of the product film 12, a gap (an air space) 40 is formed between the surface (surface) of the product film 12 and the lower surface (back) of the guide film 22 (the base film 24). Accordingly, the product film 12 is protected.

Furthermore, the winding mechanism 20 controls the torque of the winding core 32, that is, a pulling force, which is generated in a case in which the guide film 22 or the product film 12 is pulled so as to be wound around the winding core 32, by controlling the motor 30. In addition, as described above, the winding mechanism 20 controls the tension Tg of the guide film 22 in cooperation with the guide film supply mechanism 16 and controls the tension Ts of the product film 12 in cooperation with the product film supply mechanism 18.

Further, since the tension Tg of the guide film 22 and the tension Ts of the product film 12 are individually controlled by the winding device 10 as described above, the slack of the product film 12 can be prevented without the application of stress to the product film 12. That is, there is a problem that the product film 12 is broken or distorted in a case in which stress is applied to the product film 12 (in a case in which the tension Ts of the product film 12 is increased). However, since the winding device 10 increases the tension Tg of the guide film 22 to prevent the guide film 22 from loosening, the slack of the product film 12 can be prevented without an increase in the tension Ts of the product film 12. Further, since only the tension Tg of the guide film 22 is increased as described above, problems, such as the winding displacement, slack, and the like of the film roll 14, can also be prevented without the application of stress to the product film 12.

Particularly, a porous film is likely to be broken (it is difficult for a porous film to be wound with high tension) due to a structure in which a plurality of holes are formed, and this problem becomes more prominent in a porous film that has a diameter of a hole in the range of about 1 to 100 μm and a porosity in the range of 45 to 95%. For this reason, the above-mentioned effect becomes more prominent in a case in which the porous film is wound by the winding device 10 of the invention.

Further, an optical film is likely to be broken due to a small thickness, and the quality of the optical film deteriorates in a case in which damage to the optical film occurs due to the contact between the films. Particularly, an optical film having a thickness of 100 μm or less is likely to be broken, and damage caused by slight contact between films is also not allowed in an optical film of which arithmetic average roughness (Ra) is 1 μm or less. For this reason, the above-mentioned effect becomes more prominent in a case in which the porous film is wound by the winding device 10 of the invention.

Figure 4:
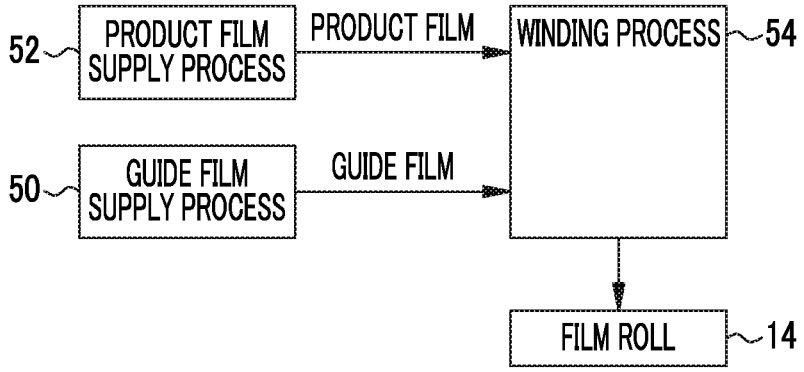
FIG. 4 is a diagram illustrating a process for winding a product film in the form of a roll.

A process for forming the film roll 14 by winding the product film 12 will be described below with reference to FIG. 4. As shown in FIG. 4, the film roll 14 is formed through a guide film supply process 50 (a guide film supply step), a product film supply process 52 (a product film supply step), and a winding process 54 (a winding step).

The guide film supply process 50 includes the above-mentioned guide film supply mechanism 16. In the guide film supply process 50, the guide film 22 is supplied to the winding process 54 (the winding core 32) by the guide film supply mechanism 16. In this case, the guide film supply mechanism 16 controls a supply force for supplying the guide film 22 and the winding mechanism 20 controls a pulling force for pulling the guide film 22, so that the tension Tg of the guide film 22 is controlled.

The product film supply process 52 includes the above-mentioned product film supply mechanism 18. In the product film supply process 52, the product film 12 is supplied to the surface side of the guide film 22 by the product film supply mechanism 18. In this case, the product film supply mechanism 18 controls a supply force for supplying the product film 12 and the winding mechanism 20 controls a pulling force for pulling the product film 12 (the guide film 22), so that the tension Ts of the product film 12 is controlled.

The winding process 54 includes the above-mentioned winding mechanism 20. In the winding process 54, the product film 12 is wound for each guide film 22 around the winding core 32 by the winding mechanism 20 and the film roll 14 is formed. In this case, the winding mechanism 20 controls a pulling force for pulling the guide film 22 or the product film 12 in a winding direction. Further, as described above, the winding mechanism 20 controls the tension Tg of the guide film 22 in cooperation with the guide film supply mechanism 16 and controls the tension Ts of the product film 12 in cooperation with the product film supply mechanism 18.

Since the guide film 22 is provided with the supports 26 that are thicker than the product film 12, a gap (an air space) 40 is formed between the surface of the product film 12 and the back of the guide film 22 in the film roll 14. Accordingly, the surface of the product film 12 is protected. Further, the tension Tg of the guide film 22 and the tension Ts of the product film 12 are individually controlled, so that the tension Tg of the guide film 22 is made larger than the tension Ts of the product film 12 in this embodiment. For this reason, the slack of the product film 12 can be prevented without the application of stress to the product film 12.

The invention is not limited to the above-mentioned embodiment, and the structures of the detailed portions can be appropriately modified. For example, an adhesive may be applied to at least one of the surface of the guide film 22 and the back of the product film 12 to form an adhesive layer, and the product film 12 supplied to the surface of the guide film 22 may be adhered to the surface of the guide film 22.

Figure 5:
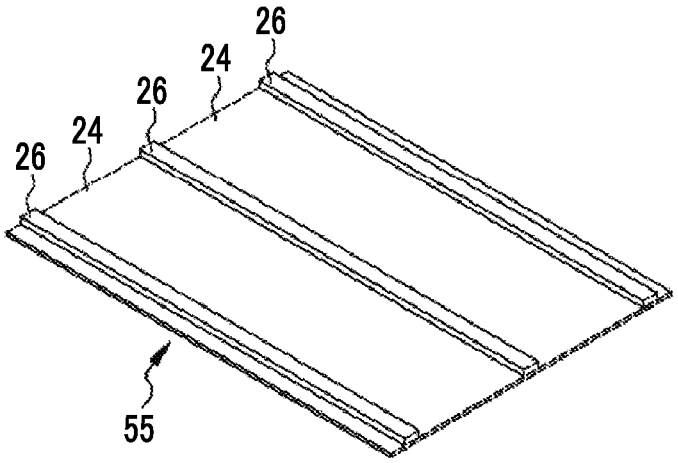
FIG. 5 is a perspective view of a guide film.
Figure 6:
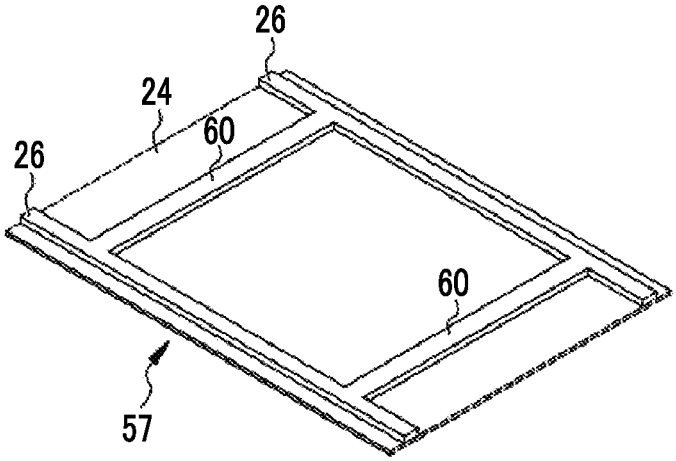
FIG. 6 is a perspective view of a guide film.
Figure 7:
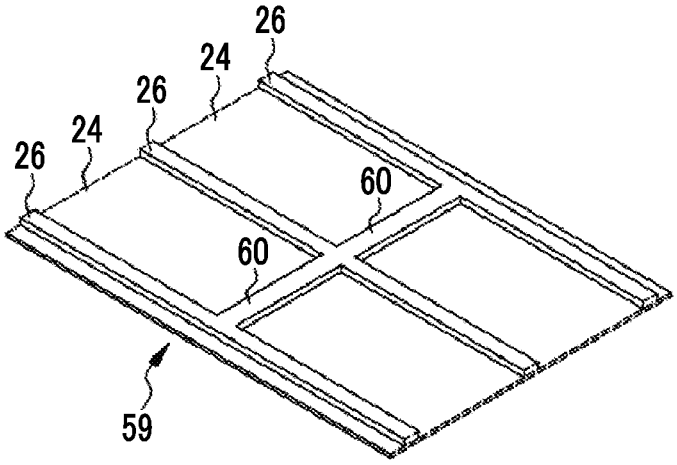
FIG. 7 is a perspective view of a guide film.

Further, as in a guide film 55 shown in FIG. 5, a support 26 may also be provided in the middle of the base film 24 in a width direction so that the supports 26 are arranged in three lines. Surely, the supports 26 may be arranged in four or more lines. Furthermore, supports 60, which are long in the width direction of the base film 24, may be provided as in a guide film 57 shown in FIG. 6. Surely, as in a guide film 59 shown in FIG. 7, three or more supports 26, which are long in the longitudinal direction of the base film 24, may be provided and a support 60, which is long in the width direction of the base film 24, may also be provided. In the description using FIGS. 5, 6, and 7, the members described above will be denoted by the same reference numerals as the reference numerals of the members described above and the description thereof will be omitted.

Figure 8:
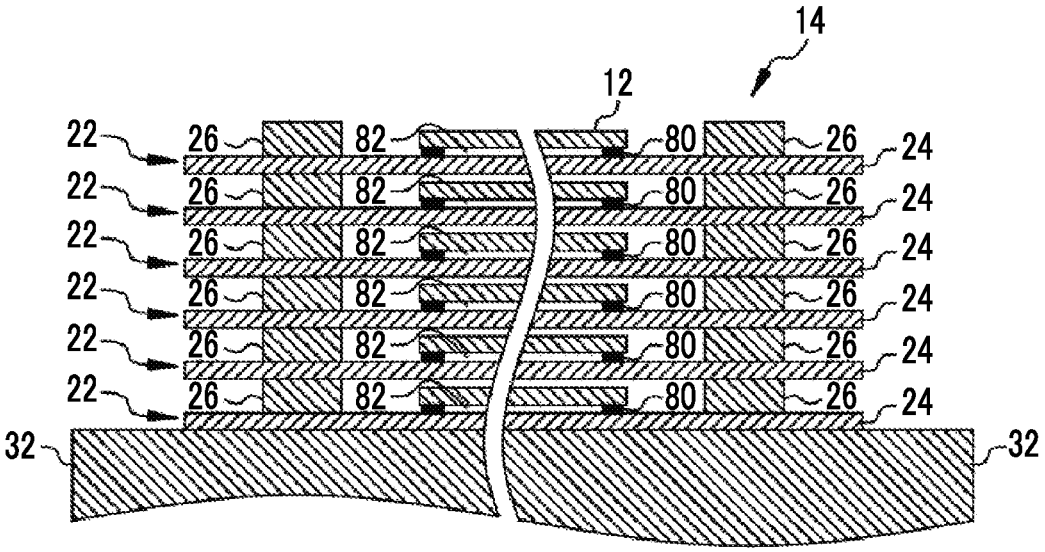
FIG. 8 is a cross-sectional view of the film roll.

Further, as shown in FIG. 8, supports 80 may be also provided between the product film 12 and the guide film 22 and also form a gap 82 (an air space) between the product film 12 and the guide film 22 (the base film 24) so that the back side of the product film 12 is also protected.

Furthermore, examples in which the base film and the support are made of different materials have been described, but the base film and the support may be made of a common material. In addition, examples in which the supports are formed separately from the base film and are disposed on the base film have been described, but the supports may be formed integrally with the base film.

For the more accurate control of the tension Tg of the guide film 22, the tension Tg of the guide film 22 between the guide film supply mechanism 16 and the winding mechanism 20 may be detected and the tension Tg of the guide film 22 may be controlled on the basis of the detected tension. Likewise, for the more accurate control of the tension Ts of the product film 12, the tension Ts of the product film 12 between the product film supply mechanism 18 and the winding mechanism 20 may be detected and the tension Ts of the product film 12 may be controlled on the basis of the detected tension. Well-known various methods can be used as a method of detecting tension, but examples of the method of detecting tension include a method of detecting the torque of the respective shafts, such as a roller for feeding the guide film 22 or the product film 12 and the winding core 32, and a method of detecting a position by a tension pick-up or a dancer.

EXPLANATION OF REFERENCES

10: winding device
12: product film
14: film roll
16: guide film supply mechanism
18: product film supply mechanism
20: winding mechanism
22, 55, 57, 59: guide film
24: base film
26, 60, 80: support
30: motor
32: winding core
34: opening
40, 82: gap (air space)
50: guide film supply process (guide film supply step)
52: product film supply process (product film supply step)
54: winding process (winding step)
Tg: tension (first tension) of guide film
Ts: tension (second tension) of product film

What is claimed is:

1. A winding method of winding a product film in the form of a film roll, the winding method comprising:

a guide film supply step of supplying a guide film, which supports the product film from a back side, toward a winding core;

a product film supply step of supplying the product film to a surface side of the guide film; and a winding step of winding the guide film around the winding core in the form of the film roll together with the product film supplied to the surface side of the guide film, wherein the guide film includes a base film and a support which is formed to have a thickness larger than the thickness of the product film and is provided on a surface of the base film, and a space is formed between the surface and back of the guide film by the support in the form of the film roll, wherein, in the winding step, the product film is disposed in the space and is wound in the form of the film roll together with the guide film, and wherein the base film and the support are in direct contact.

2. The winding method according to claim 1, wherein in the guide film supply step, tension of the guide film in a winding direction is controlled to first tension and the guide film is supplied to the winding core, and in the product film supply step, tension of the product film in the winding direction is controlled to second tension and the product film is supplied to the surface of the guide film.

3. The winding method according to claim 2, wherein the first tension is larger than the second tension.

4. The winding method according to claim 1, wherein the modulus of elasticity of the guide film is in the range of 0.1 GPa to 200 GPa.

5. The winding method according to claim 1, wherein the thickness of the guide film is in the range of 10 μm to 1000 μm.

6. The winding method according to claim 1, wherein the area of a portion, on which the support is provided, of the surface of the guide film is in the range of 0.1% to 30% of the area of the entire surface of the guide film.

7. The winding method according to claim 1, wherein the back of the product film is adhered to the surface of the guide film.

8. The winding method according to claim 1, wherein the product film is an optical film.

9. The winding method according to claim 1, wherein the product film is a porous film.

10. A winding device that winds a product film in the form of a film roll, the winding device comprising:

a guide film supply mechanism that supplies a guide film, which supports the product film from a back side, toward a winding core;

a product film supply mechanism that supplies the product film to a surface side of the guide film; and a winding mechanism that winds the guide film around the winding core in the form of the film roll together with the product film supplied to the surface side of the guide film, wherein the guide film includes a base film and a support which is formed to have a thickness larger than the thickness of the product film and is provided on a surface of the base film, and a space is formed between the surface and back of the guide film by the support in the form of the film roll, wherein, in the winding mechanism, the product film is disposed in the space and is wound in the form of the film roll together with the guide film, and wherein the base film and the support are in direct contact.

11. The winding device according to claim 10, wherein tension of the guide film in a winding direction is controlled to first tension and the guide film is supplied to the winding core, and tension of the product film in the winding direction is controlled to second tension and the product film is supplied to the surface of the guide film.

* * * * *